US009676030B2

(12) United States Patent
Guo et al.

(10) Patent No.: US 9,676,030 B2
(45) Date of Patent: Jun. 13, 2017

(54) INDUSTRIAL METHOD FOR PRODUCING DISPERSION-STRENGTHENED IRON-BASED MATERIALS AT LOW COST AND IN LARGE-SCALE

(75) Inventors: Zhimeng Guo, Beijing (CN); Weiwei Yang, Beijing (CN); Ji Luo, Beijing (CN); Huiqin Cao, Beijing (CN); Cunguang Chen, Beijing (CN)

(73) Assignee: UNIVERSITY OF SCIENCE AND TECHNOLOGY BEIJING, Beijing (CN)

( * ) Notice: Subject to any disclaimer, the term of this patent is extended or adjusted under 35 U.S.C. 154(b) by 750 days.

(21) Appl. No.: 13/989,230

(22) PCT Filed: Jun. 30, 2011

(86) PCT No.: PCT/CN2011/076644
§ 371 (c)(1),
(2), (4) Date: May 23, 2013

(87) PCT Pub. No.: WO2012/068878
PCT Pub. Date: May 31, 2012

(65) Prior Publication Data

US 2013/0236349 A1 Sep. 12, 2013

(30) Foreign Application Priority Data

Nov. 23, 2010 (CN) ..... 2010 1 0562535

(51) Int. Cl.

| | |
|---|---|
| ***B22F 3/02*** | (2006.01) |
| ***B22F 3/04*** | (2006.01) |
| ***B22F 3/12*** | (2006.01) |
| ***B22F 3/14*** | (2006.01) |
| ***B22F 9/22*** | (2006.01) |
| ***B22F 3/10*** | (2006.01) |
| ***C22C 33/02*** | (2006.01) |
| ***B22F 3/20*** | (2006.01) |

(52) U.S. Cl.
CPC ..... *B22F 3/02* (2013.01); *B22F 3/04* (2013.01); *B22F 3/10* (2013.01); *B22F 3/12* (2013.01); *B22F 3/14* (2013.01); *B22F 3/20* (2013.01); *B22F 9/22* (2013.01); *C22C 33/0228* (2013.01)

(58) Field of Classification Search
CPC ..... B22F 3/02; B22F 9/22; B22F 3/04; B22F 3/12; B22F 3/14; B22F 3/10; B22F 3/20; C22C 33/02; C22C 33/0228
USPC ..... 419/19, 63; 210/713; 423/148
See application file for complete search history.

(56) References Cited

U.S. PATENT DOCUMENTS

| | | | | |
|---|---|---|---|---|
| 4,086,321 | A * | 4/1978 | Holley | C01G 49/06 134/10 |
| 4,382,916 | A * | 5/1983 | Beecher | C01B 7/035 423/481 |
| 5,190,740 | A * | 3/1993 | Narutani | C01B 13/185 252/62.62 |
| 7,608,153 | B2 * | 10/2009 | Tayu | H01F 1/0576 148/101 |
| 8,603,213 | B1 * | 12/2013 | Anderson | B22F 9/082 148/325 |
| 2003/0116018 | A1 * | 6/2003 | Echizen | B01D 53/1406 95/199 |
| 2003/0116239 | A1 | 6/2003 | Lambard et al. | |
| 2006/0193764 | A1 | 8/2006 | Katusic et al. | |
| 2012/0048063 | A1 * | 3/2012 | Maetani | C22C 33/0271 75/246 |

FOREIGN PATENT DOCUMENTS

| | | | | |
|---|---|---|---|---|
| CN | 1664145 | | 9/2005 | |
| CN | 102091788 | * | 6/2011 | |
| WO | WO 2008/093430 A1 | * | 8/2008 | C22C 38/00 |

OTHER PUBLICATIONS

Guo et al. (CN 102091788) (attached herewith).*
International Search Report of PCT/CN2011/076644, dated Oct. 13, 2011, 6 pages total.

* cited by examiner

*Primary Examiner* — Jessee Roe
*Assistant Examiner* — John Hevey
(74) *Attorney, Agent, or Firm* — Hamre, Schumann, Mueller & Larson, P.C.

(57) ABSTRACT

The invention provides an industrial method for producing dispersion-strengthened iron-based materials at low cost and in large-scale. The industrial acid pickling waste solution is treated by spray roasting process after yttrium chloride is added. During the spray roasting process, the solution is atomized into fine droplets, the droplets are contacted with gas and dried into powders, which are heated in air to form metal oxides. The mixed powders of the metal oxides are reduced in hydrogen stream to obtain yttria dispersion-strengthened iron powders. High performance dispersion-strengthened iron materials are obtained by densifying the yttria dispersion-strengthened iron powders. The method has simple process and low cost, and is suitable for large-scale production due to the direct use of acid pickling waste solution from steel factory.

7 Claims, No Drawings

INDUSTRIAL METHOD FOR PRODUCING DISPERSION-STRENGTHENED IRON-BASED MATERIALS AT LOW COST AND IN LARGE-SCALE

BACKGROUND OF THE INVENTION

1. Field of the Invention

The present invention pertains to the field of metallic material, and belongs to the category of oxide dispersion strengthened materials. Particularly, there is provided a process in which powders of mixed oxides of yttrium oxide and ferric oxide are industrially fabricated at low cost and on a large scale by utilizing the recovery procedure of pickling liquors of industrial hydrochloric acid, and then are subjected to reduction and a densification process to fabricate an iron-based dispersion strengthened material.

Due to its low cost and good performance, the oxide dispersion strengthened iron-based material according to the present invention can be used on the occasions when excellent high-temperature strength and creep strength are required, such as material for the first wall of a nuclear fusion reactor, etc., and can be used to fabricate powder metallurgy parts of low cost and high performance besides.

2. Description of the Related Art

With the rapid development of science and technology, various thermal mechanics (gas turbines, jet engines, rockets), the aerospace industry, and the atomic energy industry have increasingly high requirements on high-temperature strength and corrosion-resistant property of heat-resistant materials. Currently, as regards a conventional heat-resistant metallic material, solid solution strengthening and precipitation hardening of precipitated phases are usually adopted as its main strengthening means. However, the precipitated phases will be aggregated and grow up at a high temperature or be solid-solved in the matrix again, so that the strengthening function is lost and its usage temperature is limited; and on the other hand, elements for solid solution strengthening each enormously reduce the anti-oxidation corrosion resistance. While for an iron-based oxide dispersion strengthened material, a metal is strengthened by a stable dispersed phase of an oxide, and accordingly, it is possible that the above limitations are overcome, the high-temperature properties and mechanical properties of general metals are improved, and the thermal stability, hardness and strength of high-temperature alloys are enhanced more effectively.

Dispersion strengthening is such a method: in a metal, second phase particles that are usually relatively stable are added or formed, so as to strengthen the alloy. The second phase particles are added into the matrix material artificially, and they are uniform, fine, and capable of pinning dislocations, particle boundaries, subparticle boundaries and impeding movement of dislocations, and have good thermal stability and chemical stability, to thereby strengthen the material. Moreover, they will not be dissolved any more when the alloy is heated to a higher temperature, and the strengthening effect can be maintained until it approximates the melting point of the alloy (0.8-0.9 $T_{melting\ point}$), so that the dispersion strengthened material still has a quite high strength, creep property and anti-oxidation property at temperatures close to the melting point. As such, it is possible that potentials of the material are exploited to a great extent, and the metallic material is fully used. The second phase particles for bringing out the strengthening effect in the metallic material have to be fine particles that are dispersed in the metal by way of being relatively uniform. It is generally thought that the finer the oxide particles are, the more uniform the distribution is, and the improvement in properties of the material is more remarkable.

At present, for the preparation of iron-based oxide dispersion materials, what is mainly adopted is the mechanical alloying technology, in which they are fabricated through a mechanical alloying process, taking Fe as original powders, Cr, Al, Ti and Mo as intermediate alloy powders, and $Y_2O_3$ as second-phase particles for dispersion strengthening. This method suffers from the following drawbacks: it has a high cost and a long production cycle, is not easy to control, tends to introduce impurities to pollute the alloy, etc. It is difficult to achieve large-scale industrial production and to assure nonexistence of coarse dispersed-phase particles by this method. The high production cost limits the scope of use of iron-based dispersion strengthened materials, which are merely used in the high-end industry at present. Therefore, to develop a fabricating process of iron-based oxide dispersion strengthened bulk materials of low cost has an important meaning in reality and a great market potential.

SUMMARY OF THE INVENTION

An object of the present invention is to provide a powder metallurgy fabrication method of a dispersion strengthened iron-based material, which has industrial application value and a low cost, namely, a process in which, powders of mixed oxides of yttrium oxide and ferric oxide are industrially fabricated at low cost and on a large scale by utilizing the recovery procedure of pickling liquors of industrial hydrochloric acid, and then they are subjected to reduction and two different densification processes so as to fabricate iron-based dispersion strengthened materials for servicing different needs. Drawbacks of an existing method that it has a high cost and a long production cycle, is not easy to control, etc. are solved.

Hot rolled strip steel can be subjected to cold rolling only if hydrochloric acid pickling has been performed on it. Upon pickling, iron and an oxide skin at surfaces of the strip steel are washed away by hydrochloric acid, and the consumed hydrochloric acid turns into chlorides that are mostly $FeCl_2$ and dissolved in the hydrochloric acid solution. The chemical equations for its main reactions are:

$$Fe+2HCl=FeCl_2+H_2O$$

$$FeO+2HCl=FeCl_2+H_2O$$

At present, pickling waste liquors are basically treated by a spray roasting technological process at home and abroad, and a large amount of by-products of $Fe_2O_3$ are obtained simultaneous with hydrochloric acid regeneration.

The principle of the present invention is: based on the selective reduction of a salt mixture subjected to spray roasting, yttrium chloride is added into a pickling waste liquor, and metal oxide mixed powders containing a dispersed phase of yttrium oxide are fabricated by utilizing a spray roasting process in the recovery procedure of the pickling waste liquor. After yttrium chloride is added into the picking waste liquor, a solution containing ferric chloride, ferrous chloride and yttrium chloride is attained, and the solution is atomized to be tiny droplets in the spray roasting process, so that the droplets contact with a gas and are dried to become powders, the powders being heated in the air to become metal oxides.

The chemical equations for its main reactions are:

$$4FeCl_2+4H_2O+O_2=2Fe_2O_3+8HCl\uparrow$$

$$2FeCl_3+3H_2O=Fe_2O_3+6HCl\uparrow$$

$$2YCl_3+3H_2O=Y_2O_3+6HCl\uparrow$$

The resultant superfine mixed powders of metal oxide are subjected to a selective reduction in a flow of hydrogen gas to thereby obtain yttrium oxide dispersion strengthened iron powders, and then a densification process is carried out. Oxide particles that are dispersedly distributed in the matrix can inhibit grain growth, so that a stable grain size is attained easily. Thus, a higher sintering temperature can be used upon cold-pressing sintering so as to attain high density.

Specific processing steps are as follows:

a. yttrium chloride is added into a hydrochloric acid pickling waste liquor containing iron (concentration of iron in the pickling waste liquor is in the range of 50-150 g/L), so as to obtain a pickling waste liquor containing matrix metal ions, by which, a metal elementary substance is finally generated, and dispersed-phase metal ions, by which, an oxide as a dispersed phase is finally generated. When raw materials are converted into quality of the oxide as the dispersed phase and the matrix metal, mass fraction of the oxide as the dispersed phase in the total alloy is in the range of 0.1-2%.

b. Let the pickling waste liquor containing matrix metal ions and dispersed-phase metal ions get into a preconcentrator, so as to concentrate the waste acid, and the concentration of iron after concentrating is in the range of 600-1500 g/L;

c. The concentrated waste acid is atomized and sprayed to be tiny droplets by a nozzle on the top of a roasting furnace, a mixture of particles of ferric chloride and ferrous chloride in the concentrated acid is roasted into free hydrogen chloride and iron oxide in a burning gas, and yttrium chloride is roasted into free hydrogen chloride and yttrium oxide.

d. Mixed oxides are reduced in $H_2$ atmosphere at 900-1000° C., with a reduction time of 60-90 minutes, so as to get dispersion strengthened iron powders with yttrium oxide as the dispersed phase.

e. The dispersion strengthened iron powders are densified by using a cold-pressing sintering process or a hot extrusion process, so as to get an iron-based dispersion strengthened material.

The cold-pressing sintering process is: the dispersion strengthened iron powders are molded by cold pressing, and in the course of molding by cold pressing, a mold pressing or a cold isostatic pressing is adopted. Pressure of the mold pressing is: 600-1200 Mpa, pressure of the cold isostatic pressing is in the 200-300 MPa range, pressure holding time is in the range of 30-90 minutes, and a vacuum sintering process is adopted, the sintering process being carried out at 1300-1400° C. under a vacuum degree of 0.1-0.01 Pa, the temperature being maintained for 60-120 minutes. The hot extrusion process is: the dispersion strengthened iron powders are loaded into a canning, which is vacuumized under a vacuum degree of $10^{-1}$-$10^{-2}$ pa for 1-2 hours firstly, and heated to 1150-1250° C. for hot extrusion, so that the dispersion strengthened iron powders are solidified.

The ferric chloride particles in the step 3 are replaced by ferrous chloride particles or a mixture of particles of ferric chloride and ferrous chloride.

The spray speed of the concentrated waste acid in the step 3 is: 200-4000 L/h; and the temperature in the spray roasting furnace is in the range of 300-700° C. Dispersed-phase $Y_2O_3$ particles are rapidly generated by reaction in situ owing to an extremely quick evaporation speed in the spray roasting process, and thus, in the prepared iron-based dispersion strengthened material, dispersed-phase $Y_2O_3$ particles are more fine and homogeneous, and no coarse $Y_2O_3$ particle is mingled with them. Further, the spray speed of the concentrated waste acid is: 1000-3000 L/h.

Advantages of the present invention are:

Dispersed-phase $Y_2O_3$ particles are rapidly generated by reaction in situ owing to an extremely quick evaporation speed in the spray roasting process of the present invention. Thus, in the iron-based dispersion strengthened material prepared by the invention, dispersed-phase $Y_2O_3$ particles are more fine and homogeneous, and no coarse $Y_2O_3$ particle is mingled with them. As compared to other process for fabricating iron-based dispersion strengthened materials in prior art (such as co-precipitation, EDTA complexing method, micro-emulsion method, etc.), the material has more excellent material properties and a good processability. It is possible that the dispersion strengthened powders are taken as raw material to fabricate filaments of the iron-based dispersion strengthened material with a size smaller than 0.2 mm.

An existing production process for recovering industrial hydrochloric acid pickling liquors is utilized by the invention to prepare dispersion iron powders of low cost. Upon preparation of powders of mixed oxides, an existing pickling waste liquor is used as raw material, and besides the cost of yttrium chloride as raw material for the dispersed phase being added, an additional cost is not required basically. Moreover, according to requirements of different usage situations, there are provided two corresponding densification processes, among which, the cold-pressing sintering has a relatively low cost, and the hot extrusion process has a relatively high cost, but has a better performance relative to the cold-pressing sintering. The present patent makes full use of accompanying regenerants in the production process of steel, and it is a typical energy-saving, emission-reduction and circular-economy technology, and is also a typical production technology of green materials.

Regarding the iron-based dispersion strengthened powders prepared by using the present invention, the pressing properties are excellent, and the material properties are excellent. The average density in the cold-pressing sintering process can be over 97%, and tensile strength at room temperature for a material containing 1% of a $Y_2O_3$ dispersed phase is larger than or equal to 400 MPa, being one times higher than pure iron; the average density with the hot extrusion process can be over 99%, and tensile strength at room temperature for a material containing 1% of a $Y_2O_3$ dispersed phase is larger than or equal to 600 MPa.

DESCRIPTION OF THE PREFERRED EMBODIMENTS

Embodiment 1: 0.1% $Y_2O_3$ dispersion strengthened iron material yttrium chloride is added into a hydrochloric acid pickling waste liquor (concentration of iron in the pickling waste liquor is 50 g/L), so as to obtain a pickling waste liquor containing matrix metal ions, by which, a metal elementary substance is finally generated, and dispersed-phase metal ions, by which, an oxide as a dispersed phase is finally generated. When raw materials are converted into quality of the oxide as the dispersed phase and the matrix metal, mass fraction of the oxide as the dispersed phase in the total alloy is 0.1%;

Let the pickling waste liquor containing matrix metal ions and dispersed-phase metal ions get into a preconcentrator, so as to concentrate the waste acid, and the concentration of iron after concentrating is 600 g/L;

The concentrated waste acid is atomized and sprayed to be tiny droplets by a nozzle on the top of a roasting furnace, the spray speed of the concentrated waste acid being 600 L/h, the temperature in the spray roasting furnace being 400° C. A mixture of particles of ferric chloride and ferrous chloride in the concentrated acid is roasted into free hydrogen chloride and iron oxide in a burning gas, and yttrium chloride is roasted into free hydrogen chloride and yttrium oxide;

Mixed oxides are reduced in $H_2$ atmosphere at 900° C., with a reduction time of 90 minutes, so as to get dispersion strengthened iron powders with yttrium oxide as the dispersed phase;

The dispersion strengthened iron powders are molded by mold pressing, with a pressing pressure of 600 Mpa, and a vacuum sintering process is used, the sintering temperature being 1300° C. and maintained for 120 minutes.

As for the prepared dispersion strengthened iron material, the relative density is 97.5%, the tensile strength at room temperature is 363 MPa, and the HRB hardness is 70.

Embodiment 2:0.5% $Y_2O_3$ dispersion strengthened iron material yttrium chloride is added into a hydrochloric acid pickling waste liquor (concentration of iron in the pickling waste liquor is 90 g/L), so as to obtain a pickling waste liquor containing matrix metal ions, by which, a metal elementary substance is finally generated, and dispersed-phase metal ions, by which, an oxide as a dispersed phase is finally generated. When raw materials are converted into quality of the oxide as the dispersed phase and the matrix metal, mass fraction of the oxide as the dispersed phase in the total alloy is 0.5%;

Let the pickling waste liquor containing matrix metal ions and dispersed-phase metal ions get into a preconcentrator, so as to concentrate the waste acid, and the concentration of iron after concentrating is 900 g/L;

The concentrated waste acid is atomized and sprayed to be tiny droplets by a nozzle on the top of a roasting furnace, the spray speed of the concentrated waste acid being 2000 L/h, the temperature in the spray roasting furnace being 700° C. A mixture of particles of ferric chloride and ferrous chloride in the concentrated acid is roasted into free hydrogen chloride and iron oxide in a burning gas, and yttrium chloride is roasted into free hydrogen chloride and yttrium oxide;

Mixed oxides are reduced in $H_2$ atmosphere at 900° C., with a reduction time of 90 minutes, so as to get dispersion strengthened iron powders with yttrium oxide as the dispersed phase;

The dispersion strengthened iron powders are loaded into a canning, which is vacuumized under a vacuum degree of $10^{-2}$ pa for 2 hours firstly, and heated to 1200° C. for hot extrusion, so that the dispersion strengthened iron powders are densified.

As for the prepared dispersion strengthened iron material, the relative density is 99%, the tensile strength at room temperature is 540 MPa, and the HRB hardness is 92.

Embodiment 3:1.0% $Y_2O_3$ Dispersion Strengthened Iron Material yttrium chloride is added into a hydrochloric acid pickling waste liquor (concentration of iron in the pickling waste liquor is 100 g/L), so as to obtain a pickling waste liquor containing matrix metal ions, by which, a metal elementary substance is finally generated, and dispersed-phase metal ions, by which, an oxide as a dispersed phase is finally generated. When raw materials are converted into quality of the oxide as the dispersed phase and the matrix metal, mass fraction of the oxide as the dispersed phase in the total alloy is 1%;

Let the pickling waste liquor containing matrix metal ions and dispersed-phase metal ions get into a preconcentrator, so as to concentrate the waste acid, and the concentration of iron after concentrating is 1000 g/L;

The concentrated waste acid is atomized and sprayed to be tiny droplets by a nozzle on the top of a roasting furnace, the spray speed of the concentrated waste acid being 3000 L/h, the temperature in the spray roasting furnace being 600° C. A mixture of particles of ferric chloride and ferrous chloride in the concentrated acid is roasted into free hydrogen chloride and iron oxide in a burning gas, and yttrium chloride is roasted into free hydrogen chloride and yttrium oxide;

Mixed oxides are reduced in $H_2$ atmosphere at 950° C., with a reduction time of 75 minutes, so as to get dispersion strengthened iron powders with yttrium oxide as the dispersed phase;

The dispersion strengthened iron powders are molded by cold isostatic pressing, the pressing pressure being 200 Mpa, the pressure holding time being 60 minutes, and a vacuum sintering process is used, the sintering temperature being 1400° C. and being maintained for 120 minutes.

As for the prepared dispersion strengthened iron material, the relative density is 98%, the tensile strength at room temperature is 430 MPa, and the HRB hardness is 86.

Embodiment 4:2.0% $Y_2O_3$ Dispersion Strengthened Iron Material yttrium chloride is added into a hydrochloric acid pickling waste liquor (concentration of iron in the pickling waste liquor is 150 g/L), so as to obtain a pickling waste liquor containing matrix metal ions, by which, a metal elementary substance is finally generated, and dispersed-phase metal ions, by which, an oxide as a dispersed phase is finally generated. When raw materials are converted into quality of the oxide as the dispersed phase and the matrix metal, mass fraction of the oxide as the dispersed phase in the total alloy is 2%;

Let the pickling waste liquor containing matrix metal ions and dispersed-phase metal ions get into a preconcentrator, so as to concentrate the waste acid, and the concentration of iron after concentrating is 1500 g/L;

The concentrated waste acid is atomized and sprayed to be tiny droplets by a nozzle on the top of a roasting furnace, the spray speed of the concentrated waste acid being 4000 L/h, the temperature in the spray roasting furnace being 700° C. A mixture of particles of ferric chloride and ferrous chloride in the concentrated acid is roasted into free hydrogen chloride and iron oxide in a burning gas, and yttrium chloride is roasted into free hydrogen chloride and yttrium oxide;

Mixed oxides are reduced in $H_2$ atmosphere at 1000° C., with a reduction time of 60 minutes, so as to get dispersion strengthened iron powders with yttrium oxide as the dispersed phase;

The dispersion strengthened iron powders are loaded into a canning, which is vacuumized under a vacuum degree of $10^{-2}$ pa for 2 hours firstly, and heated to 1250° C. for hot extrusion, so that the dispersion strengthened iron powders are densified.

As for the prepared dispersion strengthened iron material, the relative density is 99%, the tensile strength at room temperature is 710 MPa, and the HRB hardness is 103.

What is claimed is:

1. A method for industrially producing an iron-based strengthened dispersion material, wherein:

step 1, adding yttrium chloride into a waste hydrochloric acid pickling liquor containing iron to obtain waste pickling liquor containing matrix metal ions and dispersed-phase metal ions;

step 2, transferring the waste pickling liquor containing matrix metal ions and dispersed-phase metal ions into a preconcentrator, and concentrating the waste pickling liquor containing matrix metal ions and dispersed-phase metal ions to obtain a concentrated waste pickling liquor;

step 3, atomizing the concentrated waste pickling liquor into tiny droplets by spraying the concentrated waste pickling liquor through a nozzle on the top of a roasting furnace, roasting the tiny droplets to obtain an oxide mixture of ferric oxide and yttrium oxide, wherein particles of ferric chloride in the concentrated pickling liquid are roasted into free hydrogen chloride and iron oxide in a burning gas, and yttrium chloride is roasted into free hydrogen chloride and yttrium oxide;

step 4, reducing the oxide mixture in $H_2$ atmosphere at 900-1000° C. for 60-90 minutes to obtain strengthened dispersion iron powders with yttrium oxide as a dispersed phase; and step 5, densifying the strengthened dispersion iron powders with yttrium oxide by a cold-pressing sintering process or a hot extrusion process to obtain the iron-based strengthened dispersion material, wherein the matrix metal ions result in elemental metal, and the dispersed-phase metal ions result in dispersed-phase oxide.

2. The method for industrially producing the iron-based strengthened dispersion material of claim 1 wherein the cold-pressing sintering process is including:

a. molding the strengthened dispersion iron powders with yttrium oxide by cold pressing to obtain a molded strengthened dispersion iron powders, wherein, in the process of molding by cold pressing, a mold pressing or a cold isostatic pressing is adopted, pressure of the mold pressing is 600-1200 Mpa, pressure of the cold isostatic pressing is in a range of 200-300 MPa, pressure holding time is in a range of 30-90 minutes;

b. performing vacuum sintering on the molded strengthened dispersion iron powders, wherein the sintering temperature is in a range of 1300-1400° C., the temperature is maintained for 60-120 minutes, and the vacuum degree is in a range of 0.1-0.01 Pa.

3. The method for industrially producing the iron-based strengthened dispersion material of claim 1, wherein the hot extrusion process including:

loading the strengthened dispersion iron powders with yttrium oxide into a can, and heating it to 1150-1250° C. for hot extrusion after vacuuming under a vacuum degree of $10^{-1}$-$10^{-2}$ pa for 1-2 hours, so that the strengthened dispersion iron powders are solidified.

4. The method for industrially producing the iron-based strengthened dispersion material of claim 1, wherein the waste hydrochloric acid pickling liquor has an iron concentration in a range of 50-150 g/L.

5. The method for industrially producing the iron-based strengthened dispersion material of claim 1, wherein the concentrated waste pickling liquor has an iron concentration in a range of 600-1500 g/L.

6. The method for industrially producing the iron-based strengthened dispersion material of claim 1, wherein the spraying has a speed of 200-4000 L/h; and the temperature in the roasting furnace is in a range of 300° C. -700° C.

7. The method for industrially producing the iron-based strengthened dispersion material of claim 6 wherein the spraying has a speed of 1000-3000 L/h.

* * * * *